US005979383A

United States Patent [19]

Faville et al.

[11] Patent Number: 5,979,383

[45] Date of Patent: Nov. 9, 1999

[54] ROCKER ARM ASSEMBLY LUBRICATION

[75] Inventors: Joyce K. Faville, Avon; Cynthia Ann Greene, Rochester, both of N.Y.

[73] Assignee: General Motors Corporation, Detroit, Mich.

[21] Appl. No.: 09/298,390

[22] Filed: Apr. 23, 1999

[51] Int. Cl.[6] ..... F01L 1/18; F01M 9/10

[52] U.S. Cl. ..... 123/90.36; 123/90.43; 123/90.41; 184/6.9

[58] Field of Search ..... 123/90.33, 90.35, 123/90.36, 90.39, 90.41, 90.42, 90.43, 90.44, 90.46, 196 R, 196 M; 184/6.5, 6.9

[56] References Cited

U.S. PATENT DOCUMENTS

| | | | |
|---|---|---|---|
| 3,289,657 | 12/1966 | Winter, Jr. | 123/90.41 |
| 4,624,223 | 11/1986 | Wherry et al. | 123/90.44 |
| 4,961,407 | 10/1990 | McWhirter | 123/90.41 |
| 4,979,475 | 12/1990 | Mills | 123/90.39 |
| 5,325,825 | 7/1994 | Schmidt et al. | 123/90.39 |
| 5,566,652 | 10/1996 | Deppe | 123/90.35 |
| 5,584,267 | 12/1996 | Muir | 123/90.39 |
| 5,671,707 | 9/1997 | Purcell et al. | 123/90.37 |

FOREIGN PATENT DOCUMENTS

| | | |
|---|---|---|
| 4234868A1 | 4/1994 | Germany . |
| 19624413A1 | 1/1998 | Germany . |

*Primary Examiner*—Weilun Lo
*Attorney, Agent, or Firm*—Vincent A. Cichosz

[57] ABSTRACT

A rocker arm assembly includes a U-shaped rocker arm defined by a bottom wall and, two side walls depending upwardly therefrom where the side walls each have a central axle opening to support a transversely extending roller axle. A roller for rolling against a cam is rotatably supported on the roller axle through a roller bearing. The bottom wall of the rocker arm has a centrally located opening providing clearance for rotation of the roller and a spherical socket at a first end of the rocker arm to interface with an upper rounded end of a hydraulic lash adjuster. An oiling channel is provided along the bottom wall extending from the spherical socket, towards the roller, to terminate at the centrally located opening for channeling oil expelled from the hydraulic lash adjuster, wherein reciprocation of the rocker arm flings oil from the channel to the roller and roller bearing for lubrication.

5 Claims, 2 Drawing Sheets

ROCKER ARM ASSEMBLY LUBRICATION

TECHNICAL FIELD

The present invention relates to a rocker arm assembly for actuating an engine valve.

BACKGROUND OF THE INVENTION

It is known in the art of rocker arm assemblies to provide a small lubrication hole in the socket of a rocker arm to transmit oil expelled from a hydraulic lash adjuster. The oil may be directed through the hole to lubricate the roller and roller bearing; the oil typically will not lubricate the rocker arm-to-valve interface as the hole directs oil above the rocker arm assembly and not to the lower rocker arm face. The small lubrication hole is usually machined into the rocker arm in a secondary operation. Machining may create burrs which may block the hole or which may break off and increase the potential for wear.

SUMMARY OF THE INVENTION

The present invention provides a rocker arm assembly which provides for lubrication of both the roller bearing and rocker arm-to-valve stem interface. An oiling channel is added to the spherical socket of the rocker arm to tap into an oil reservoir between the socket and the upper end of the hydraulic lash adjuster. The channel extends from the oil reservoir, along the bottom surface of the rocker arm to a rectangular opening for the roller. During operation, oil is expelled from a bore in the upper end of the hydraulic lash adjuster to fill the oil reservoir for lubricating the lash adjuster-to-rocker arm socket interface. The oiling channel taps into the oil reservoir and provides a path for oil to be redirected from the lash adjuster-to-rocker arm interface. The rapid reciprocating motion of the rocker arm flings oil from the end of the channel to the roller, roller bearing, and rocker arm-to-valve stem interface, providing beneficial lubrication. Since the channel directs oil to the underside of the rocker arm, and not above it, the rocker arm-to-valve stem interface receives lubrication.

DESCRIPTION OF THE PREFERRED EMBODIMENT

Figure 1:
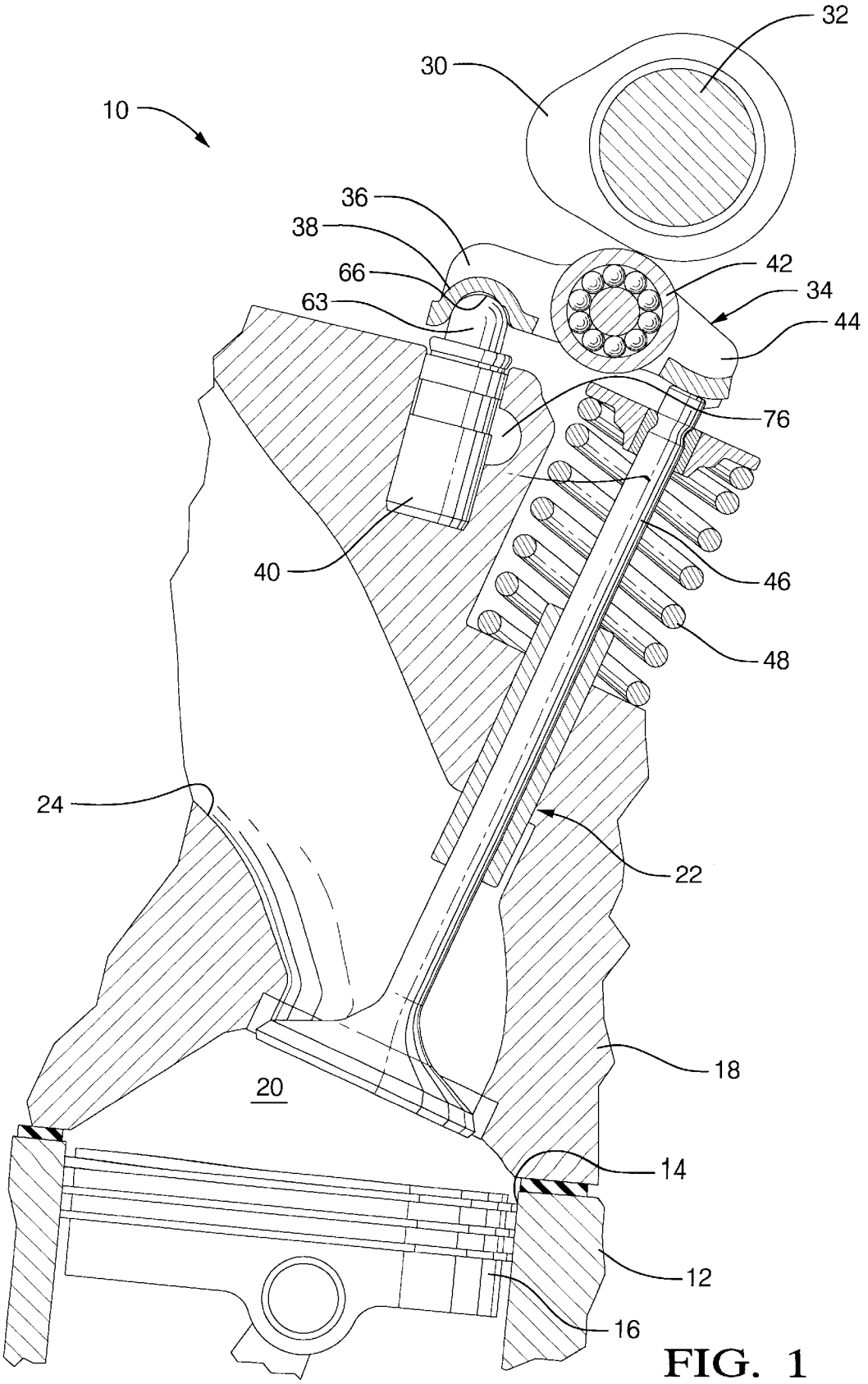
FIG. 1 is a partial, sectional view of a rocker arm assembly in an overhead cam internal combustion engine.

Referring to FIG. 1, there is shown a portion of an overhead camshaft internal combustion engine, designated generally as 10. The engine 10 includes an engine cylinder block 12 with a plurality of engine cylinders 14. An engine piston 16 is disposed within each cylinder 14 for reciprocal movement. An engine cylinder head 18 is mounted on the cylinder block 12 and cooperates with each piston 16 to define a combustion chamber 20 therebetween.

Each cylinder 14 has an intake valve 22 to supply air, and fuel in some applications, to the combustion chamber 20 from an intake passage 24, and an exhaust valve, not shown, to exhaust the combustion gases through an exhaust passage, not shown. The intake valve 22 is seated in the end of the intake passage 24 which adjoins the cylinder 14.

Valve actuation will be discussed with reference to the intake valve 22. A cam 30, disposed on a camshaft 32, actuates the valve 22 via a rocker arm assembly .34. In the end-pivot configuration shown, a rocker arm 36 pivots at a first end 38 on a hydraulic lash adjuster 40 that is assembled in the cylinder head 18. Intermediate of the rocker arm 36, the arm contacts the cam 30 directly through a roller cam follower 42. At a second end 44, the rocker arm 36 actuates a valve stem 46 to open the valve 22. A valve return spring 48 acts to close the valve 22. Other rocker arm configurations may be used such as a center-pivot configuration.

Figure 2:
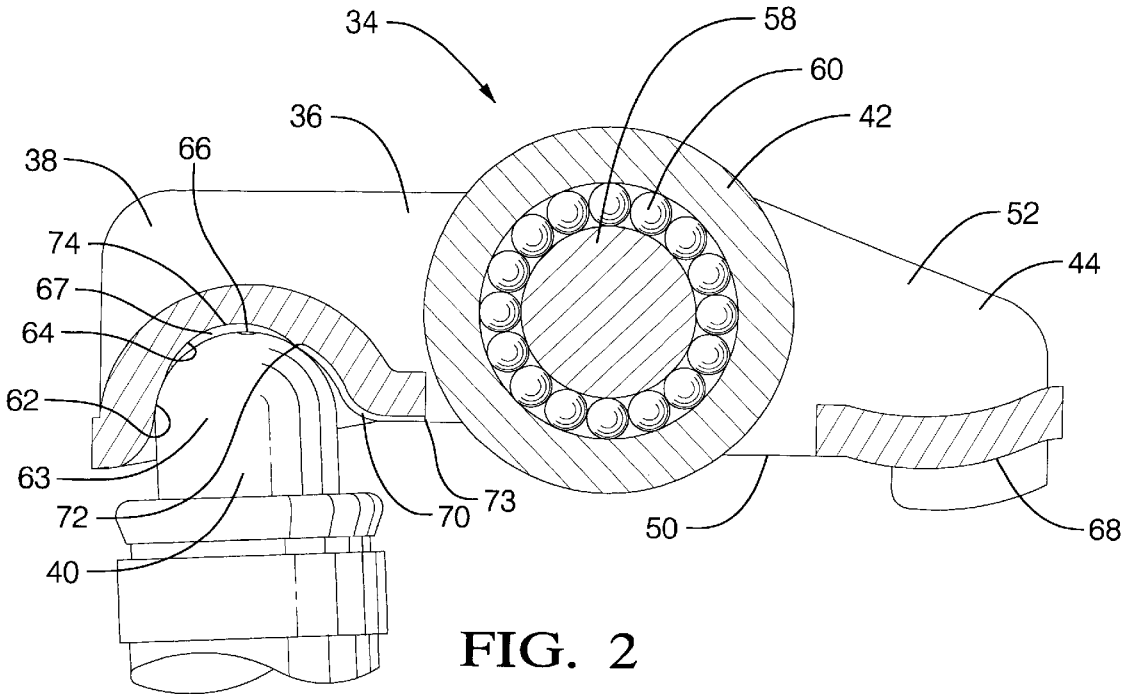
FIG. 2 is an enlarged sectional side view of the rocker arm of FIG.1.
Figure 3:
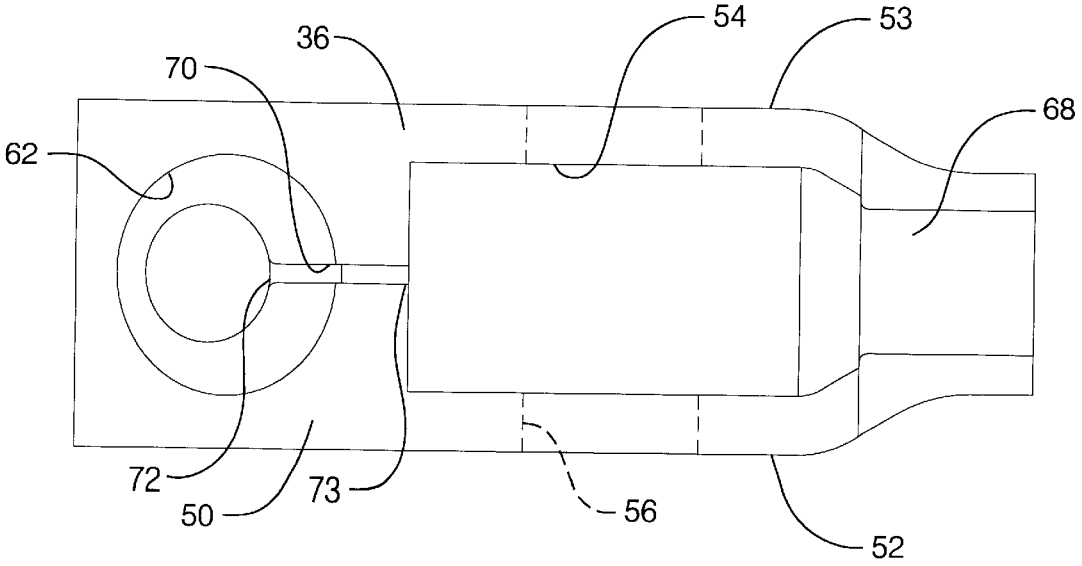
FIG. 3 is an enlarged bottom view of the rocker arm of FIG. 2.

The rocker arm assembly 34 is illustrated in greater detail in FIGS. 2 and 3. The rocker arm 36 has a generally U-shaped configuration with a bottom wall 50 and two side walls 52,53 depending upwardly therefrom. The side walls 52,53 each include an axle opening 56 to support a transversely extending roller axle 58 upon which roller 42 is mounted for rolling contact with cam 30. Needle-type bearings 60 are disposed between the roller 42 and axle 58. As shown in FIG. 3, the bottom wall 50 includes a centrally-located rectangular opening 54 to provide clearance for rotation of roller 42.

At the first end 38 of the rocker arm 36, there is a spherical socket 62 in the bottom wall 50 operable to receive the upper rounded end 63 of the hydraulic lash adjuster 40. The deepest portion 74 of the socket 62 includes a relief region 64 which provides a gap to allow oil to be expelled through a bore 66 in the upper rounded end 63 of the lash adjuster 40 to lubricate the interface between the lash adjuster and the rocker arm socket. An oil reservoir 67 is created between the upper end 63 of the lash adjuster 40 and the relief region 64 of the socket 62 as the oil is expelled from the lash adjuster. At the second end 44 of the rocker arm 36, the bottom wall 50 includes a stepped radiused pallet 68 which interfaces with the top of the valve stem 46.

To provide additional oil lubrication to the roller 42, roller bearings 60, and the pallet 68 for the valve stem 46, an oiling channel 70 is provided along the rocker arm 36, which taps into the oil reservoir 67 and channels oil to other portions of the valve train. The channel 70 is defined by its two ends, a supply end 72 and a distribution end 73. The supply end 72 intersects the oil reservoir 67 defined between the socket 62 and the upper end 63 of the hydraulic lash adjuster. The distribution end 73 intersects the rectangular opening 54, provided for the roller 42. Therefore the channel 70 extends from the supply end 72, inboard towards the roller 42 and along a portion of the bottom wall 50, to the distribution end 73. The channel 70 provides a path for oil to be redistributed from the oil reservoir 67 to provide further valve train lubrication. The channel 70 may be formed as part of the rocker arm 36 during stamping, casting, or metal injection molding, or may be manufactured during secondary machining operations. The dimension of the channel 70 is such that excessive amounts of oil are not channeled away from the lash adjuster 40 so as to not adversely affect system oil pressure.

During operation, oil is delivered to the hydraulic lash adjuster 40 through an oil passage 76, FIG. 1, in the cylinder head 18. Excess oil is expelled through the bore 66 in the upper end 63 of the adjuster 40, filling the oil reservoir 67. By capillary action and slight pressure, the oil flows in the supply end 72 of the intersecting oiling channel 70 and therethrough. The rapid motion of the rocker arm 36 flings oil from the distribution end 73 of the channel 70 onto the roller 42 and to the pallet 68 thereby lubricating the bearing 60 and the interface to the valve stem 46. Since the oil is sprayed from the underside of the rocker arm, the oil provides lubrication of the rocker arm-to-valve stem interface that may not otherwise be possible if the oil was sprayed from the top side of the rocker arm.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A rocker arm assembly comprising a rocker arm having U-shaped configuratiorn comprising a bottom wall and two side walls depending upwardly therefrom, said side walls each having a central axle opening to support a transversely extending roller axle, a roller for rolling against a cam and rotatably supported on said roller axle through a roller bearing, said bottom wall having a centrally located opening providing clearance for rotation of said roller, a spherical socket at a first end of said rocker arm to interface with an upper rounded end of a hydraulic lash adjuster, and a channel provided along said bottom wall extending from said spherical socket, towards said roller, to terminate at said centrally located opening for channeling oil expelled from said hydraulic lash adjuster, wherein reciprocation of said rocker arm flings oil from said channel to said roller and roller bearing for lubrication.

2. A rocker arm assembly, as defined in claim 1, further comprising a relief region in said spherical socket of said rocker arm to define an oil reservoir between said upper rounded end of said hydraulic lash adjuster and said relief region.

3. A rocker arm assembly, as defined in claim 2, wherein said channel intersects said oil reservoir, channeling oil from said oil reservoir to a distribution end of said channel intersecting said centrally located opening of said bottom wall of said rocker arm.

4. A rocker arm assembly, as defined in claim 1, further comprising a pallet in said bottom wall at a second end of said rocker arm to interface a valve stem for valve actuation wherein reciprocation of said rocker arm flings oil from said channel to said pallet for lubrication.

5. A rocker arm assembly, as defined in claim 4, wherein said pallet is a stepped and radiused surface.

* * * * *